US005955414A

United States Patent [19]

Brown et al.

[11] Patent Number: 5,955,414

[45] Date of Patent: Sep. 21, 1999

[54] CLEANING FOAM HAVING FLUORINATED STAIN REPELLENT AND LOW FLAMMABILITY

[75] Inventors: Colin W. Brown, Dorset; Gerald L. Hart, Surrey; David F. Holmes, Devon, all of United Kingdom

[73] Assignee: S. C. Johnson & Son, Inc., Racine, Wis.

[21] Appl. No.: 08/809,428

[22] PCT Filed: Oct. 5, 1995

[86] PCT No.: PCT/US95/12930

§ 371 Date: Aug. 4, 1997

§ 102(e) Date: Aug. 4, 1997

[87] PCT Pub. No.: WO96/11249

PCT Pub. Date: Apr. 18, 1996

[30] Foreign Application Priority Data

Oct. 5, 1994 [GB] United Kingdom ..... 9420037

[51] Int. Cl.[6] ..... C11D 1/75; C11D 3/37; C11D 3/24; C11D 3/18

[52] U.S. Cl. ..... 510/279; 510/278; 510/280; 510/475; 510/476; 510/503; 510/291; 510/299; 510/333

[58] Field of Search ..... 510/278, 279, 510/280, 475, 476, 503, 291, 299, 333

[56] References Cited

U.S. PATENT DOCUMENTS

| | | | |
|---|---|---|---|
| 3,723,357 | 3/1973 | Hansen | 252/545 |
| 3,723,358 | 3/1973 | Morgan et al. | 252/546 |
| 3,835,071 | 9/1974 | Allen et al. | 252/545 |
| 4,013,595 | 3/1977 | Podella et al. | 252/545 |
| 4,089,804 | 5/1978 | Falk | 252/355 |
| 5,259,848 | 11/1993 | Terry et al. | 8/111 |
| 5,338,475 | 8/1994 | Corey et al. | 252/102 |
| 5,439,610 | 8/1995 | Ryan et al. | 252/174.23 |
| 5,514,302 | 5/1996 | Brown | 252/545 |
| 5,534,167 | 7/1996 | Billman | 510/280 |

*Primary Examiner*—Mark Kopec
*Assistant Examiner*—Charles Boyer

[57] ABSTRACT

An aerosol foam cleaning composition for carpets and other soft-furnishings is provided. It has a volatile hydrocarbon propellant, a surfactant, a foam stabilizer polymer, a stain repellent fluorocarbon, an amine oxide foam booster, and water. The foam does not release hydrocarbon propellant at such a rate so as to create flammability problems, yet provides adequate residual stain repellent.

11 Claims, 2 Drawing Sheets

Graph 1 - Flammability / Oil Repellency vs Teflon Level

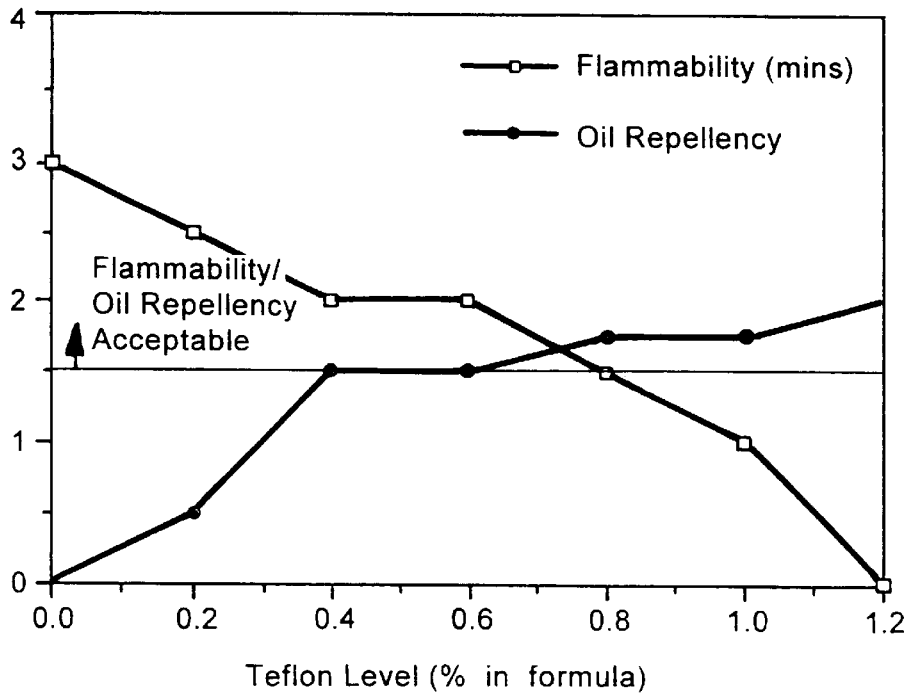
Fig. 1 Graph 1 - Flammability / Oil Repellency vs Teflon Level
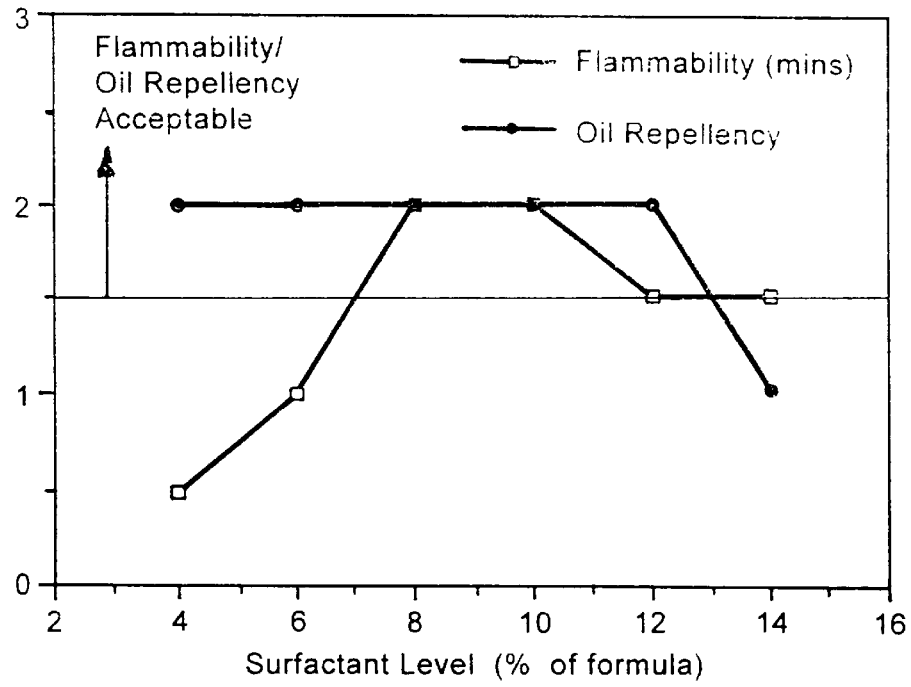
Fig. 2 Graph 2- Flammability / Oil Repellency vs Surfactant Blend Level

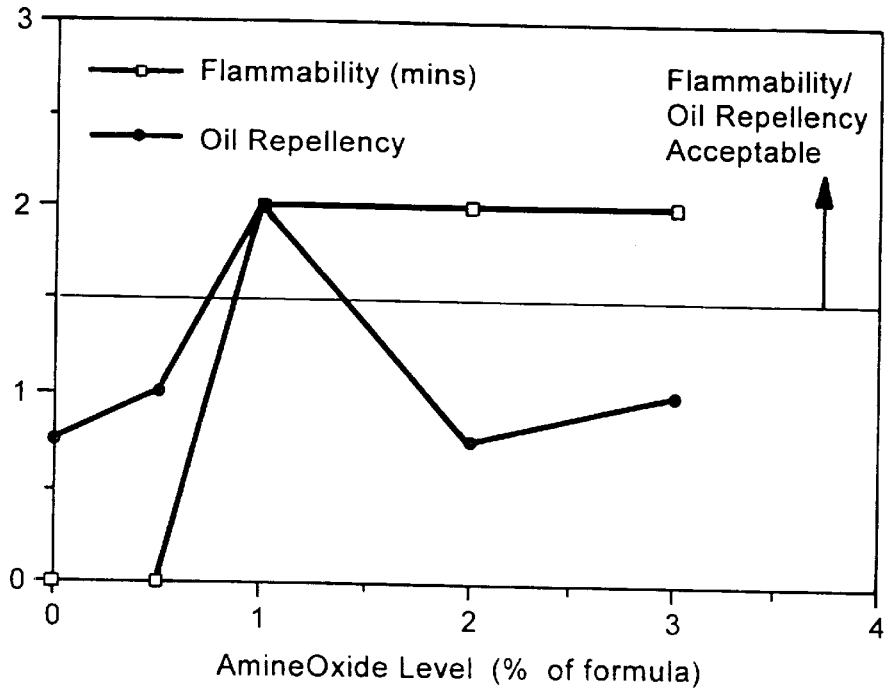
Fig. 3 Graph 3 - Flammability / Oil Repellency vs Amine Oxide Level
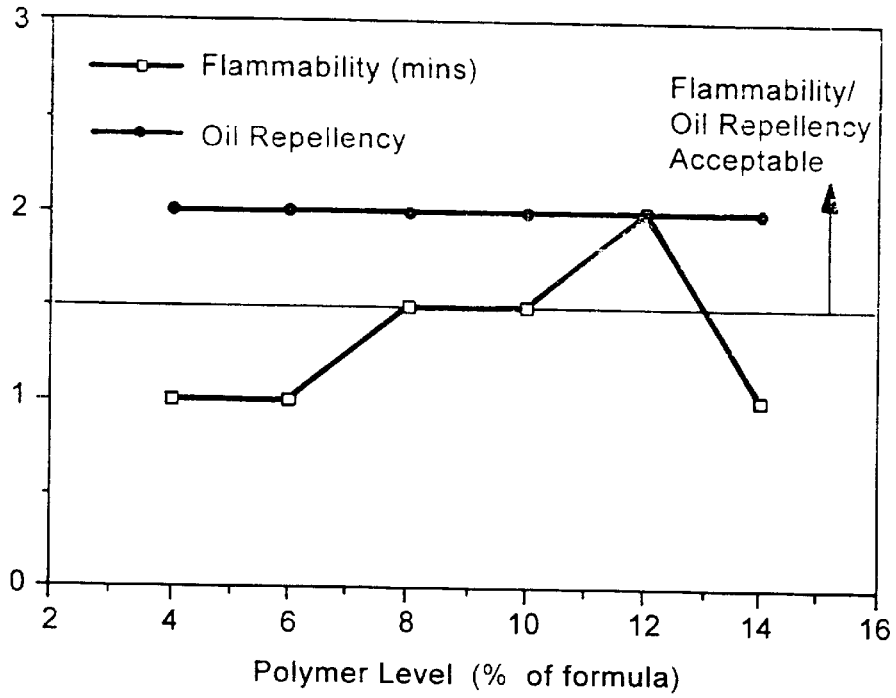
Fig. 4 Graph 4 - Flammability / Oil Repellency vs Polymer Level

CLEANING FOAM HAVING FLUORINATED STAIN REPELLENT AND LOW FLAMMABILITY

TECHNICAL FIELD

The present invention relates to aqueous aerosol foam cleaning compositions, particularly for use on carpets and upholstery.

DISCLOSURE OF INVENTION

The invention is summarized as an aerosol foam-cleaning aqueous composition containing hydrocarbon propellant, foam-stabilizing polymer, surfactant, foam booster and a fluorinated stain-repellent, in which composition the proportions of the said components provide a foam of anti-flammability stability and sufficient residual amount of stain-repellent.

BRIEF DESCRIPTION OF DRAWINGS

FIGS. 1–4 are graphs of flammability and oil repellency data from the tests described, below, in the Modes of Carrying out the Invention.

MODES OF CARRYING OUT THE INVENTION

Aerosol foam compositions for shampooing floor-coverings such as carpets or soft furnishings such as upholstery commonly comprise blends of surfactants and foam-stabilizer polymers, together with various other ingredients such as solvents, corrosion inhibitors and fragrances. The polymer stabilizes the foam produced and assists in the cleaning. In an aerosol composition, a volatile hydrocarbon liquid propellant commonly is used to create a foam, the most commonly used propellant being butane.

A typical foam cleaning aerosol composition might comprise an aqueous dispersion of acrylic/styrene copolymer, sodium lauryl sulfate; ammonia; preservative and perfume, all in water; and a propane/butane blend as propellant. Such a composition would possess the following advantages:

(a) excellent pick-up;

(b) good anti-soiling;

(c) very high powder hardness;

(d) fast drying;

(e) good wetting;

(f) excellent removability; and (g) improved foam stability.

The foam resulting from these aerosols has a stability dependent on the combination of the properties of the components, such as the amount of surfactant and the nature of the polymer and the other foaming agents. This stability will also affect the rate of release of butane or other hydrocarbon from the foam structure. Since the hydrocarbons, particularly butane, are very inflammable, this rate of release can influence the flammability properties of the foam structure and particularly the risk of ignition if the foam is applied close to an ignition source. However, the permissible amounts and the relative ratios of the components can usually vary widely and still provide otherwise operable compositions.

In U.S. Pat. No. 4,013,595 there is described a foam composition of the above type in which flammability is adjusted by addition of lauryl alcohol to a composition containing lauryl sulfosuccinate. In such compositions, stain blocking agents have been suggested including, for example, sulfonic acid condensates. A stain blocking agent interacts with the substrate being cleaned to prevent staining materials subsequently interacting with the substrate.

Applicant has also been considering the use of stain repellents, materials treating the substrate material by forming a coating. Such stain-repellents include fluoro stain repellents, particularly oil repellent components that provide a stain-repellent finish to the material being treated with a foam cleaner, the finish remaining after cleaning is completed. Particular stain repellents are fluorocompounds such as fluoropolymers. However, Applicant's attempts to combine these fluorocompounds with aerosol foam cleaning compositions have resulted in foams that are unstable and that release hydrocarbon at an excessive rate, giving rise to flammability problems.

It has now been found that non-volatile fluorocompound stain repellent compounds can be combined with the other components of a foam cleaning composition to provide a product that retains appropriate foam stability to provide a composition sufficiently non-flammable for use with improved safety even where there are potential ignition sources, such as open fires, cigarettes, and the like. These non-volatile fluorocompounds are added not as part of the propellant but as a part of the non-propellant portion of the cleaning composition. Fluorocompounds have been added to cleaning foams in the past, but those fluorocompounds were volatile compounds added as part of the propellant.

According to the invention there is provided an aerosol foam-cleaning aqueous composition containing hydrocarbon propellant, foam-stabilizer polymer, surfactant, foam booster and a fluorinated stain repellent in which the proportions of the said components provide a foam of anti-flammability stability and that leaves behind on the surface being cleaned an effective amount of stain repellent left as residual on the surface. "Anti-flammability stability" is defined here to mean that the rate of collapse of the foam does not release the hydrocarbon propellant at a rate that creates a flammability problem having regard to the standards established in the industry and described in detail in this patent. An "effective amount" of an ingredient is defined to be an amount sufficient to achieve the specified result or effect. An amount of stain repellent left as residual on a surface is deemed effective if it reduces the tendency of the surface to receive and retain visually apparent stains.

The precise proportions of polymer, surfactant, fluorinated stain repellent and active components such as foam boosters will be governed by the specific components selected. But, once a group of components has been selected, the adjustment of the proportions necessary to achieve the desired stability, cleaning characteristics, and post-application stain repellency will be readily determinable by reference to the proportions taught in this patent.

In one embodiment of the present invention there is provided an aerosol foam cleaning composition comprising an aqueous foam structure composition that is by weight:

(a) from 2.4 to 4.5 weight percent of at least one surfactant;

(b) from 2.00 to 3.5 weight percent of at least one foam-stabilizer polymer;

(c) from 0.1 to 0.2 weight percent of at least one fluoro stain-repellent compound;

(d) 0.25 to 0.5 weight percent of at least one foam booster; and (e) the balance water.

From 2.5 to 3.5 weight percent of at least one volatile hydrocarbon propellant is provided in the total aerosol composition, with the balance being the foam structure composition just described. Although the propellant participates in the "foam structure," the term "foam structure composition" as used herein refers to the total of those components other than the volatile propellant that contribute to the foaming characteristics of the cleaning composition.

Thus the invention comprises an aerosol foam cleaning or shampoo formulation particularly for carpets or other soft furnishings, preferably comprising specified amounts of the particular components set out above. The particular composition relies on the presence of a volatile hydrocarbon liquid propellant, preferably butane, to create a foam on actuation. It is essential that the foam generated be sufficiently stable, and foam stability depends upon, inter alia, the amount and nature of surfactant utilized, the amount and nature of polymer utilized, the presence or absence of other foaming aids, and the amount of fluorocompounds present. As mentioned above, the fluoro stain repellent compounds are added to such compositions to provide a post-cleaning, stain repellent finish and particularly an oil-repellent finish on the carpet, and can be fluoropolymer compounds or fluorosurfactant compounds. However, it has been found that the presence of such fluorocompounds in the foam has a marked influence on the surface tension thereof and therefore can greatly decrease the stability of the foam, which in turn leads to a marked increase in ignition potential. This is because, if the foam decreases in stability, then the level and rate of release therefrom of the volatile hydrocarbon propellant will increase. Since volatile hydrocarbon propellants are flammable, then their release above certain levels cannot be permitted in compositions of the type described herein without the production of unacceptable flammability.

With the composition so described, there is sufficient surfactant, sufficient polymer and sufficient foam booster that the foam produced is sufficiently stable to be effective as a cleaning composition, while the amount of surfactant and polymer is not so high as to impair the post-cleaning performance of the fluorocompounds.

The amount of flammable volatile hydrocarbon propellant is carefully selected to be high enough that sufficient foam is generated but not so high that a flammable mixture is created.

The composition must include sufficient fluorocompounds that an adequate level of post-cleaning stain repellency exists on the carpet after cleaning, while the composition remains sufficiently non-flammable.

Having regard to the functions and effects of the various components, the precise amount of each component may have to be adjusted in a particular composition to achieve maximum cleaning activity and stability of foam.

A number of materials can be utilized as the foam-stabilizer polymeric component of the foam cleaning compositions of the present invention, including the styrene maleic anhydride and related resins as disclosed in U.S. Pat. No. 3,835,071. In addition to these compositions, resins as disclosed in U.S. Pat. Nos. 3,723,358 and 3,723,357 also can be used. Preferred are the various acrylate copolymers and terpolymers, such as methyl methacrylate-methacrylic acid copolymers and styrene-methyl methacrylate-methacrylic acid terpolymers. Most preferred are the acrylic polymers. In addition to providing foam stability, these polymers are primary cleaning agents in these compositions and provide the function of soil entrapment when dry as well as some anti-resoil benefits.

A preferred acrylic polymer for use in the invention is a copolymer of styrene and acrylic acids. A particular such acrylic polymer available commercially is JONCRYL 8660, which is provided as an aqueous emulsion of styrene and acrylic acid. This styrene/acrylic acid copolymer is available as an aqueous dispersion containing from 20–30 weight percent resin, with the balance being water. The JONCRYL 8660 aqueous dispersion is an off-white, semi-translucent liquid. Since this acrylic polymer is commercially available as an aqueous emulsion, an appropriate adjustment has to be made in formulating the composition of the subject invention to allow for the presence of water. Thus, to provide a composition containing approximately 2 weight percent acrylic copolymer, JONCRYL 8660 dispersion would be added in an amount of 25 weight percent of composition. JONCRYL 8660 is available from S. C. Johnson & Son, Inc., of Racine, Wis., and is also distributed by Specialty Chemicals Mijdrecht b.v., P.O. Box 259, 3640 AG Mijdrecht, The Netherlands.

As noted above with respect to JONCRYL 8660, in commercial practice, many components of the composition of the invention are obtained as aqueous or organic solvent dispersions. The proportions of the active components stated in this description are based on the practical amounts of commercial preparations used, and are calculated from the proportion purported to be present in the commercial material added. However, some allowance must be made for commercial variance in the materials supplied, together with the possible effects of relatively inert materials also present in such commercial dispersions.

The surface active agents that are particularly useful in the present invention are anionic and nonionic synthetic organic detergents. These detergents can be used alone or in combination with other anionic or nonionic detergents.

Examples of anionic organic detergents are alkyl glyceryl ether sulfonates, alkyl sulfonates, alkyl mono-glyceride sulfates or sulfonates, alkyl polyethoxy ether sulfonates, alkyl aryl sulfonates, acyl sarcosinates, acyl esters of isethionates, alkyl esters of sulfosuccinic acid, and alkyl phenol polyethoxy sulfonates. In these compounds, the alkyl and the acyl groups respectively contain 10 to 20 carbon atoms. They are used in the form of water-soluble salts, such as, by way of example only, sodium, potassium and ammonium salts. Specific examples of the anionic organic detergents include sodium lauryl sulfate, sodium dodecyl sulfonate and sodium N-lauroyl sarcosinate.

Examples of nonionic organic detergents include polyethylene oxide condensates of alkyl phenols wherein the alkyl group contains from 6 to 12 carbon atoms and the ethylene oxide is present in a molar ratio of ethylene oxide to alkyl phenol in the range of 10:1 to 25:1; condensation products of ethylene oxide with the product resulting from the reaction of propylene oxide and ethylene diamine wherein the molecular weight of the condensation products ranges from 5,000 to 11,000; the condensation product of from about 5 to 30 moles of ethylene oxide with one mole of a branched or straight-chain aliphatic alcohol containing from 8 to 18 carbon atoms; and trialkyl amine oxides and trialkyl phosphine oxides wherein one alkyl group ranges from 10 to 18 carbon atoms and two alkyl groups range from one to three carbon atoms.

The preferred surfactants utilized in the present invention are anionic surfactants. A particular desirable surfactant blend is a mixture of sodium lauryl sulfate and di-sodium cocoamido sulfosuccinate. This particular surfactant blend is available from Rewo Chemicals Limited, Flimby Works, Maryport, Cumbria, CA15 8RP, England, under the trade name Rewopol TS 35. Rewopol TS 35 is provided in a dispersion of 35% in water to form a liquid. Since Rewopol TS 35 is provided as an aqueous preparation, appropriate adjustment has to be made to the composition to allow for the presence of water in the commercially available material. Thus, even though the surfactant blend is present in the above mentioned range of 2.4 to 4.5, for this reason the commercial Rewopol TS 35 would in preferred practice form approximately 35% of the composition (giving about 3.4% of active material).

Amine oxides are added to act as foam boosters and assist in stabilizing the foam. However, excessive amine oxide could adversely affect the fluoro stain repellent that can be used in the composition of the invention. Suitable foam boosters can be any one of several commercially available amine oxides or mixtures thereof. A preferred amine oxide is of the formula $CH_3(CH_2)_{10}CH_2—N(CH_3)_2\rightarrow 0$. However, other foam boosters can be employed.

One such commercially available amine oxide is EMPIGEN OB available from Albright & Wilson. Another such is AMMONYX LO while another is BARLOX. AMMONYX LO is lauryl dimethyl amine oxide and appears as a light straw liquid and is available from the Onxy Chemical Company, which is a division of the Millmaster Onyx Corporation, Jersey City, N.J. 07302, U.S.A.. BARLOX 12 is cocodimethylamine oxide available as a 30% aqueous solution from Lonza Inc., 22-10 Route 208, Fair Lawn, N.J. 08410, U.S.A. When formulating the composition of the invention, an appropriate adjustment would need to be made to take account of the fact that some of the materials available are provided as aqueous solutions.

The fluoro stain repellent useful in the subject invention can be one of the fluoro materials known in the art to have this function and that is capable of being dispersed in the compositions. Such materials are generally fluoro polymers, optionally with surfactant groups, and are available as aqueous dispersions. The fluoro compounds useful in compositions made in accordance with the invention, unlike the volatile and relatively low molecular weight stain repellent materials previously used as part of the propellant, are left on the substrate after the treatment. They are either fluorosurfactants or fluoropolymers or a mixture thereof. If the fluorocompound is a fluorosurfactant, then the amount of other surfactant required may be reducible by the amount of the fluorosurfactant present. One such suitable fluorosurfactant is ZONYL 7950 available from Du Pont Chemicals, Wilmington, Del. 19898, U.S.A. ZONYL 7950 is a fluorinated surfactant provided in an aqueous/isopropyl alcohol solution, and the water involved must be taken into account when calculating the weight percentages of the ingredients of a composition made in accordance with the invention.

To improve cleaning of oily dirt, from 0–5% and more preferably from about 2% to 5% by weight of an organic solvent is optionally, but preferably, included within the compositions of the present invention. Examples of such solvents can be alcohols such as ethyl alcohol and isopropanol; glycol ether solvents such as propylene glycol monomethyl ether, tripropylene glycol butyl ether, dipropylene glycol n-butyl ether, dipropylene glycol dimethyl ether, ethylene glycol monoethyl ether, and ethylene glycol monobutyl ether; as well as propylene carbonate. Preferred are glycol ethers and especially preferred is a mixture of propylene glycol monomethyl ether and dipropylene glycol methyl ether.

The propellant used in the invention may be any volatile hydrocarbon liquid propellant of the type generally utilized in the art. As examples only, butane or a mixture of propane/butane is suitable. Preferably the propellant is butane.

In addition to the above required ingredients, minor amounts, typically less than 5% of the total foam structure composition, of conventional additives may be included as optional ingredients. These include preservatives and antimicrobial agents such as substituted diphenyl ethers; optical brighteners such as distyrylbiphenyl derivatives or stilbene derivatives; dyes; fragrances and deodorants; stain-blocking agents such as aromatic sulfonic acid condensates or carboxylated polymer salts; anti-redeposition agents such as mixtures of a nonionic surfactants or sodium salts of modified polyacrylic acids or sodium salts of maleic anhydride/olefin copolymers; ultraviolet light absorbing compounds such as 2-hydroxy4-methoxy benzophenone or 2-hydroxy-4-methoxy benzophenone-5-sulfonic acid; detergent builders such as borax; chelating agents; anti-corrosion agents; and anti-static agents. A pH adjuster may also be required, for example an alkali metal hydroxide and particularly potassium hydroxide.

The balance of the composition of the subject invention is water, and preferably deionized water.

The aerosol composition of the invention can be prepared by any conventional method of combining foam forming materials and propellant, for example by (a) confining said propellant in a compartment of an aerosol canister at a pressure of 48 psig;

(b) confining the balance of the ingredients in a second compartment of said aerosol canister;

(c) allowing said propellant to escape from said first compartment to said second compartment.

EXAMPLE

A carpet or upholstery aerosol composition was formed by combining the following foam structure components:

| Material | % w/w |
|---|---|
| Water | 73.05 |
| Acrylic styrene polymer Joncryl 8660 (25%)* | 8.00 |
| Glycol ether solvent*** | 4.00 |
| Surfactant Blend (35%)(Rewopol TS35)* | 9.70 |
| Amine Oxide (Empigen OB)* | 1.00 |
| Fluorocompound (Zonyl 7950)* | 0.50 |
| Incidental ingredients** | 3.75 |
| Total Foam Structure Composition | 100.00 |
| This was packaged as outlined above to produce the aerosol composition: | |
| Foam Structure Composition | 97.00 |
| Propellant Butane 48 PSIG | 3.00 |
| Total: | 100.00% |

*Supplied as an inert organic solvent aqueous solution or dispersion.
**Incidental components: detergent builders, corrosion inhibitors, fragrance, stain blocking agent.
***Mixture of propylene glycol methyl ether and dipropylene glycol methyl ether.

The composition demonstrated acceptable flammability, foam cleaning and post-cleaning oil repellency.

TEST METHODOLOGY

Samples of foam cleaners were tested by the following methods:

1. Flammability

For the purpose of this evaluation, a modification of the watch glass test is used. Six watch glasses are prepared, each with an equivalent size ball of foam (actuated at time zero for all six glasses). The experiment is performed in a fume cupboard with no air flow activated. At thirty second intervals, a naked flame is introduced to one of the glasses and removed immediately. The foam is observed for partial flash, total flash, and sustained burn. The limit of acceptable flammability is the time when the foam flashes but does not sustain the burn (and the foam is observed to burn on the next reading). As an arbitrary figure, a time of 90 seconds was selected as the acceptable is limit, below which the formula would be rejected.

2. Oil Repellency

The method used for this evaluation follows the procedure set out in the AATCC test method, AATCC 118-1978 Oil Repellency:Hydrocarbon Resistance Test.

In practical terms, virgin short cut pile white nylon carpet is used (i.e carpet that has been removed from the mill prior to dyeing and finishing with any protective treatments). The aerosol foam to be tested is applied to sections of this carpet under normal usage conditions and shampooed well into the pile. The swatches are allowed to dry for 24 hours and then are vacuumed to remove any product residues. The various hydrocarbons listed in the test method then are applied to the treated sections of the carpet in the form of 3–5 mm droplets. The drops are observed after 30 seconds to see if they are beading, wetting over the surface, or soaking into the pile. The score assigned to each formula represents the highest oil still beading on the carpet. If an oil is observed to flatten (wet) on the surface but not soak in, the score is assigned as half a unit above the previous number. On this type of carpet an acceptable score would be 1.5, below which, the repellency would not be significant.

TESTS

In the attached drawings, FIGS. 1–4 illustrate the effects on flammability and oil repellency observed by changing the concentrations of the various composition components in the manner indicated in the following tests.

1. Variation of Fluoro Stain Repellent

Graph 1 (FIG. 1) shows the effect on flammability and oil repellency of incremental changes in the amount of the fluorocompound (fluorosurfactant) in the formula described below. Using the limitations of acceptability for the two parameters, it can be seen from the data that there is a particular range of inclusion of fluorosurfactant within which both flammability and oil repellency are acceptable. This range is 0.1–0.2% by weight of 100% active fluorocompound. Above this level, the flammability becomes too great, while below this level the oil repellency tails off.

2. Variation of Surfactant Blend Level

Graph 2 (FIG. 2) displays data showing the effect of varying the amount of the surfactant blend used in the formula described below. The acceptable range for inclusion of this material, based on the parameters of flammability and oil repellency (using a standard inclusion of fluorosurfactant within the range of the data in Graph 1) is 2.4–4.5% by weight of 100% active surfactant. The most effective range is 2.45–4.2%.

3. Variation of Foam Booster (Amine Oxide) Level

Graph 3 (FIG. 3) displays data showing the effect of varying the amount of amine oxide. When added as a foam booster, amine oxide has a very adverse effect on oil repellency at higher concentrations of amine oxide, while having a very positive effect on flammability. The range of acceptable overall effect within the standard formula is 0.25–0.55% by weight of 100% active material. The most effective range is 0.255–0.45%.

4. Variation of Polymer Level

The polymer included in the formula described below does not seem to have much of an effect on the oil repellency and only a limited effect on flammability, both of these parameters being mainly influenced by the surfactants and fluorocompounds in the system. However, based on the data displayed in Graph 4 (FIG. 4), a preferred range is established of 2.0–3.5% by weight of 100% active polymer. The most effective range is 2.0–3.125%.

Formulae of the Compositions Used in the Tests:

1. Change in Surfactant Type/Level

| Base 1 Raw Material | % by weight |
|---|---|
| Acrylic/Styrene emulsion Polymer | 8.00 |
| Glycol ether solvent | 4.00 |
| Fluorocompound stain repellent Zonyl 7950 (25%) | 0.50 |
| Balance Water and incidental components** | to 85% |

** Incidental components: detergent builders, corrosion inhibitors, fragrance, stain blocking agent etc. 3.75%.

| | % by weight | | | | | | | | | |
|---|---|---|---|---|---|---|---|---|---|---|
| Raw Material | A | B | C | D | E | F | G | H | I | J |
| Base 1 | 85 | 85 | 85 | 85 | 85 | 85 | 85 | 85 | 85 | 85 |
| Deionised water | 10 | 8 | 6 | 4 | 2 | 0 | 5 | 4.5 | 3 | 2 |
| Surfactant Blend (35%) | 4 | 6 | 8 | 10 | 12 | 14 | 10 | 10 | 10 | 10 |
| Amine Oxide (30%) | 1 | 1 | 1 | 1 | 1 | 1 | 0 | 0.5 | 2 | 3 |

2. Change in Fluorinated Component

| Base 2 Raw Material | % by weight |
|---|---|
| Acrylic Polymer emulsion (25%) | 8.00 |
| Surfactant Blend (35%) | 9.70 |
| Glycol solvent | 4.00 |
| Amine Oxide (30%) | 1.00 |
| Balance water and incidental ingredients** | Balance to 98.8% |

** Incidental ingredients, see note to Base 1 about 3.75% by weight

| | % by weight | | | | | | |
|---|---|---|---|---|---|---|---|
| Raw Material | A | B | C | D | E | F | G |
| Base 2 | 98.8 | 98.8 | 98.8 | 98.8 | 98.8 | 98.8 | 98.8 |
| Deionised Water | 1.2 | 1.0 | 0.8 | 0.6 | 0.4 | 0.2 | 0.0 |
| Fluorinated surfactant (Zonyl 7950, 25%) | 0.0 | 0.2 | 0.4 | 0.6 | 0.8 | 1.0 | 1.2 |

3. Change in Polymer Level

| Base 3 Raw Material | % by weight |
|---|---|
| Glycol solvent | 4.00 |
| Surfactant Blend (35%) | 9.70 |
| Amine Oxide (30%) | 1.00 |
| Fluorocompound Zonyl 7950 (25%) | 0.50 |
| Water and incidental ingredients** | Balance |

** See note to Base 1 about 3.75% by weight incidental ingredients

| | % by weight | | | | | |
|---|---|---|---|---|---|---|
| Raw Material | A | B | C | D | E | F |
| Base 3 | 85 | 85 | 85 | 85 | 85 | 85 |
| Deionised Water | 11 | 9 | 7 | 5 | 3 | 1 |
| Acrylic/styrene Polymer for Cleaner (25%) | 4 | 6 | 8 | 10 | 12 | 14 |

For all of the formulae above, the following conditions hold:

pH adjusted to 8.5 using KOH (50%).

Product filled by weight 97.00% Formula with 3.00% Butane 48 PSIG propellant.

Conventional invert-use valve (no dip tube) and foam actuator used.

Formulae produced using same batches of raw materials.

Data Relating to Tables

| | % Inclusion | Flammability (mins) | Oil Repellency |
|---|---|---|---|
| Graph 1 | 0.0 | 3.0 | 0.0 |
| Fluorosurfactant | 0.2 | 2.5 | 0.5 |
| 25% Active) | 0.4 | 2.0 | 1.5 |
| | 0.6 | 2.0 | 1.5 |
| | 0.8 | 1.5 | 1.75 |
| | 1.0 | 1.0 | 1.75 |
| | 1.2 | 0.0 | 2.0 |
| Graph 2 | 4.0 | 0.5 | 2.0 |
| (Surfactant Blend) | 6.0 | 1.0 | 2.0 |
| 35% Active) | 8.0 | 2.0 | 2.0 |
| | 10.0 | 2.0 | 2.0 |
| | 12.0 | 1.5 | 2.0 |
| | 14.0 | 1.5 | 1.0 |
| Graph 3 | 0.0 | 0.0 | 0.75 |
| (Amine Oxide | 0.5 | 0.0 | 1.0 |
| 30% Active) | 1.0 | 2.0 | 2.0 |
| | 2.0 | 2.0 | 0.75 |
| | 3.0 | 2.0 | 1.0 |
| Graph 4 | 4.0 | 1.0 | 2.0 |
| (Polymer | 6.0 | 1.0 | 2.0 |
| 25% Active) | 8.0 | 1.5 | 2.0 |
| | 10.0 | 1.5 | 2.0 |
| | 12.0 | 2.0 | 2.0 |
| | 14.0 | 1.0 | 2.0 |

Industrial Applicability

The composition of the invention is immediately applicable to the industrial need for cleaning products of the sort disclosed having controlled flammability. The practical practice of the invention is described, above.

We claim:

1. An aqueous aerosol foam cleaning composition comprising from 2.5 to 3.5 weight percent of at least one volatile hydrocarbon propellant, the balance of the composition being a foam structure composition comprising by weight of the foam structure composition:

(a) from 2.4 to 4.5 weight percent of at least one surfactant that is other than an amine oxide surfactant;

(b) from 2.00 to 3.5 weight percent of at least one foam-stabilizer polymer;

(c) from 0.1 to 0.2 weight percent of at least one stain-repellent fluorocompound;

(d) from 0.25 to 0.5 weight percent of at least one amine oxide foam booster; and (e) water; wherein the proportions of said components provide a foam of anti-flammability, stability, and with a sufficient residual amount of stain repellant.

2. A composition according to claim 1, wherein said propellant includes butane.

3. A composition according to claim 1 wherein said amine oxide is $CH_3(CH_2)_{10}CH_2—N(CH_3)_2\rightarrow 0$.

4. A composition according to claim 1, wherein said foam stabilizer polymer is an acrylic polymer.

5. A composition according to claim 4 wherein said acrylic polymer is a copolymer of styrene and acrylic acid.

6. A composition according to claim 1, wherein said fluorinated stain repellent compound is selected from the group consisting of a fluorosurfactant, a fluoropolymer, or a mixture thereof.

7. A composition according to claim 1, which also contains an organic solvent in an amount not exceeding 5% by weight of the foam structure composition.

8. A composition according to claim 7 wherein said solvent is a glycol ether.

9. A composition according to claim 8 wherein said glycol ether is selected from the group consisting of propylene glycol methyl ether, dipropylene glycol methyl ether, or mixtures thereof.

10. A composition according to claim 1, further comprising a stain blocking agent.

11. A composition according to claim 1, which contains as incidental ingredients one or more of preservatives and antimicrobials, anti-corrosion agents, optical brighteners, fragrances and deodorants, anti-redeposition agents, ultraviolet absorbents, detergent builders, chelating agents, anti-static agents and pH adjusters.

* * * * *